US010239664B2

(12) United States Patent
Yeager

(10) Patent No.: US 10,239,664 B2
(45) Date of Patent: Mar. 26, 2019

(54) BOTTOM-GUSSETED PACKAGE AND METHOD

(71) Applicant: Innoflex Incorporated, Mobile, AL (US)

(72) Inventor: James W. Yeager, Mobile, AL (US)

(73) Assignee: Innoflex Incorporated, Birmingham, AL (US)

( * ) Notice: Subject to any disclaimer, the term of this patent is extended or adjusted under 35 U.S.C. 154(b) by 482 days.

(21) Appl. No.: 14/815,610

(22) Filed: Jul. 31, 2015

(65) Prior Publication Data

US 2016/0194116 A1 Jul. 7, 2016

Related U.S. Application Data

(63) Continuation-in-part of application No. 14/266,477, filed on Apr. 30, 2014, now Pat. No. 9,126,383,
(Continued)

(51) Int. Cl.
*B31B 70/00* (2017.01)
*B65D 30/20* (2006.01)
(Continued)

(52) U.S. Cl.
CPC ..... *B65D 31/10* (2013.01); *B31B 70/00* (2017.08); *B31B 70/60* (2017.08); *B65D 33/24* (2013.01);
(Continued)

(58) Field of Classification Search
CPC .... B65D 31/10; B65D 33/24; B65D 33/2533; B65D 75/008; B31B 70/00; B31B 70/60;
(Continued)

(56) References Cited

U.S. PATENT DOCUMENTS 4,055,109 A 10/1977 Kan
4,264,317 A * 4/1981 Feldkamper ..... B31B 70/00 493/213
(Continued)

FOREIGN PATENT DOCUMENTS

JP 2004151288 A 6/2004
JP 2004203393 A 7/2004
(Continued)

OTHER PUBLICATIONS

International Search Report and Written Opinion for PCT Application No. PCT/US14/56729.
(Continued)

*Primary Examiner* — Sameh Tawfik
(74) *Attorney, Agent, or Firm* — Wood, Phillips, Katz, Clark & Mortimer

(57) ABSTRACT

A bottom-gusseted package comprises a package body, and a bottom gusset positioned transversely of a longitudinal axis of the package body. Formation of the bottom-gusseted package is effected by positioning individual sleeves transversely of the longitudinal axis of a flexible web which forms the package body. During package formation, the flexible web is cut to form individual packages, with each individual sleeve positioned to form a bottom gusset in a respective package. Optionally, the individual sleeve portions can be configured such that when the flexible web is cut to form individual packages, and each individual sleeve is be cut to form a bottom gusset in one package, and a top sleeve portion in an adjacent package.

8 Claims, 16 Drawing Sheets

Related U.S. Application Data which is a continuation-in-part of application No. 14/034,154, filed on Sep. 23, 2013, now Pat. No. 9,272,481.

(60) Provisional application No. 61/734,114, filed on Dec. 6, 2012.

(51) Int. Cl.

| | |
|---|---|
| ***B65D 33/24*** | (2006.01) |
| ***B65D 33/25*** | (2006.01) |
| ***B65D 75/00*** | (2006.01) |
| ***B31B 70/60*** | (2017.01) |
| *B31B 155/00* | (2017.01) |
| *B31B 160/20* | (2017.01) |
| *B31B 70/64* | (2017.01) |
| *B31B 70/81* | (2017.01) |

(52) U.S. Cl.
CPC ..... *B65D 33/2533* (2013.01); *B65D 75/008* (2013.01); *B31B 70/642* (2017.08); *B31B 70/8133* (2017.08); *B31B 2155/00* (2017.08); *B31B 2155/002* (2017.08); *B31B 2155/0012* (2017.08); *B31B 2160/20* (2017.08)

(58) Field of Classification Search
CPC ..... B31B 70/642; B31B 2155/00; B31B 2155/002; B31B 2160/20; B31B 70/8133; B31B 2155/0012
USPC ..... 493/218
See application file for complete search history.

(56) References Cited

U.S. PATENT DOCUMENTS

| | | | | |
|---|---|---|---|---|
| 4,617,683 | A | 10/1986 | Christoff | |
| 4,651,504 | A | 3/1987 | Bentsen | |
| 4,909,017 | A | 3/1990 | McMahon et al. | |
| 5,236,531 | A | 8/1993 | Yokoyama | |
| 5,437,406 | A | 8/1995 | Gordon et al. | |
| 5,826,401 | A | 10/1998 | Bois | |
| 5,902,047 | A | 5/1999 | Yeager | |
| 6,286,191 | B2 | 9/2001 | Van Erden | |
| 6,425,847 | B1 * | 7/2002 | Broenstrup | B31B 70/00 493/186 |
| 6,517,660 | B2 * | 2/2003 | Ausnit | B31B 70/00 156/269 |
| 6,634,158 | B1 * | 10/2003 | Bois | B65B 9/20 53/551 |
| 6,719,678 | B1 | 4/2004 | Stern | |
| 6,783,276 | B2 | 8/2004 | MacHacek et al. | |
| 6,928,791 | B2 | 8/2005 | Ausnit | |
| 6,971,794 | B2 | 12/2005 | Yeager | |
| 7,331,917 | B2 | 2/2008 | Totani | |
| 8,182,407 | B2 | 5/2012 | Yeager | |
| 8,414,465 | B2 * | 4/2013 | Totani | B65D 31/10 493/162 |
| 8,616,768 | B2 | 12/2013 | Inagaki et al. | |
| 9,050,770 | B1 * | 6/2015 | Russell | B31B 29/60 |
| 2004/0258332 | A1 * | 12/2004 | Totani | B65D 31/10 383/120 |
| 2005/0178087 | A1 * | 8/2005 | Melchoir | B65B 61/188 53/412 |
| 2007/0092166 | A1 * | 4/2007 | Anzini | B65B 9/20 383/63 |
| 2007/0230834 | A1 * | 10/2007 | Schneider | B65D 33/2591 383/64 |
| 2011/0019943 | A1 | 1/2011 | Piraneo | |

FOREIGN PATENT DOCUMENTS

| | | | |
|---|---|---|---|
| JP | 2004292028 | A | 10/2004 |
| JP | 2010105741 | | 5/2010 |
| JP | 2012152901 | A | 8/2012 |
| WO | 2012099197 | A1 | 7/2012 |

OTHER PUBLICATIONS

Machine Translation of Japanese Document No. 2012-152901. Translated on Feb. 5, 2015.

Supplementary Partial European Search Report and Provisional Opinion dated Apr. 21, 2017.

* cited by examiner $$G_W \leq BP_W - [(2 \times T_{TD}) - C_{TD}]$$

$$G_{SS} \geq (2 \times T_{TD}) + C_{TD}$$

BOTTOM-GUSSETED PACKAGE AND METHOD

TECHNICAL FIELD

The present invention relates generally to packages formed from polymeric film webs, and more particularly to a bottom-gusseted package including a bottom gusset positioned transversely of a longitudinal axis of the package, with the configuration of the package, and its method of formation, permitting use with associated form, fill, and seal equipment.

BACKGROUND OF THE INVENTION

Packages formed from plastic, polymeric film material have found widespread application in the market place for convenient and efficient packaging of all manner of food and non-food products. Packages of this nature typically are formed by folding and sealing a web of polymeric material to form a package body having front and rear package panels, with the package panels joined to each other at margins thereof. Depending upon the method of formation, the front and rear package panels may be joined to each other either by folded portions of the package body, or at seals (typically heat seals) joining the package panels to each other.

Non-gusseted packages of this type are sometimes referred to as "pillow packs", and do not include either side gussets or top or bottom gussets. However, for many applications it is desirable to form a gusseted package that is, providing the package with inwardly-extended, pleat-like gussets at one or more margins of the package body. For example, side-gusseted packages include inwardly extending side gussets at opposite lateral sides of the package body, which side gussets join respect lateral edges of the front and rear package panels to each other.

For some applications, it is especially desirable to provide a bottom-gusseted package, that is, a package having an inwardly extending gusset at the bottom of the package body. By virtue of the breadth and stability provided by the bottom gusset, packages of this nature can frequently be configured to be self-standing, promoting efficient display for consumer selection.

Heretofore, bottom-gusseted packages have typically been formed by pleating a web of polymeric material in a direction parallel to the longitudinal axis of the web. Suitable ploughs and forming guides shape and configure the polymeric web as it moves longitudinally, including formation of a continuous, inwardly extending bottom gusset in the web material. Subsequently, suitable seals are formed transversely of the web to define individual package bodies, each including front and rear package panels, with each including a bottom gusset. Individual package bodies are formed by cutting the web of material at the transversely extending seals, with the contents of each package deposited therein either before or after cutting of the web into individual packages. Formation of an upper seal, at the margin of the folded polymeric web opposite the bottom gusset, closes and seals each package body. By this formation technique, the bottom gusset has a width that corresponds to and is the same as the width of the front and rear package panels.

As will be appreciated by this typical formation technique, the height or vertical dimension of each package body is approximately equal to one-half of the width of the polymeric web, less the dimension of the bottom gusset. As a consequence, the maximum height of any package being formed is essentially limited by the maximum width of the web of polymeric material which the forming equipment is capable of handling.

The present invention contemplates a bottom-gusseted package, and a method of formation, which addresses the shortcomings in the conventional forming of bottom-gusseted package. In essence, this is achieved by forming each package with a bottom gusset positioned transversely of the longitudinal axes of the polymeric film web and each package. The bottom-gusseted packages of any selected height can be readily and efficiently formed.

SUMMARY OF THE INVENTION

A bottom-gusseted package embodying the principles of the present invention comprises a package body formed from a flexible web having a longitudinal axis. The flexible web is folded to define a front package panel and a rear package of the package body. The front and rear package panels are joined to each other at respective lateral side margins of the package body, with the flexible web being joined to itself along a seam which extends parallel to the longitudinal axis of the flexible web.

Notably, a package formed in accordance with the present invention includes a bottom gusset positioned between the front and rear package panels, with the bottom gusset extending upwardly and inwardly from the lower edges of the front and rear package panels. By formation of the present package in accordance with the present invention, the bottom gusset is positioned within the package body transversely of the longitudinal axis of the package body, and transversely of the longitudinal axis of the flexible web from which the package body is formed. As a consequence, a package body can be very efficiently formed at any selected height, without necessarily being limited by the width of the flexible web from which the package is formed.

Notably, the versatility of the method of package formation in accordance with the present invention permits formation of a bottom-gusseted package in different configurations. In one illustrated embodiment, a bottom-gusseted package is formed which includes a recloseable fastener assembly at the upper portion of the package. In alternative embodiments, a bottom-gusseted package is formed with a top sleeve portion generally opposite the bottom gusset, wherein the top sleeve portion can be configured to include a dispensing feature, or an upper package seal. However, it is within the purview of the present invention that the invention be practiced for forming packages with a bottom gusset only, without a top sleeve portion.

The present bottom-gusseted package can be formed by folding the flexible web of material generally at the longitudinal axis thereof, and joined lateral margins of the flexible web providing a seam at one side edge of the package. The bottom gusset of the package thus extends generally between the longitudinal axis of the web of material and the package seam. In alternative embodiment, a bottom-gusseted package is formed with the seam at which the web material is joined to itself is positioned in the rear package panel. By virtue of the formation technique, the bottom gusset of the package extends less than the width of the front and rear package panels.

The method of formation of a bottom-gusseted package in accordance with the present invention comprises the steps of providing flexible web of material having a longitudinal axis. Suitable polymeric material can be employed by virtue of its liquid-impermeable characteristics, and heat-sealing capabilities.

Together with a flexible web of material, the present method contemplates that a flexible, sleeve-forming web is provided. The sleeve-forming web is folded and generally tubular, and can be configured to include a series of recloseable fastener assemblies, a series of upper package seal, or other features. It is presently preferred that an inside surface of the folded, sleeve-forming web does not heat-seal to itself, thus facilitating formation of a bottom gusset which spreads or opens to permit the packages being formed to be generally self-standing. The specific composition of the materials from which the package body and bottom gusset are formed can be selected as appropriate for specific applications. For example, the sleeve-forming web, which forms the bottom gussets, can be made from a material which is different than the flexible web which forms the package body The present method further comprises the step of cutting the flexible, sleeve-forming web into a plurality of individual sleeves, each having a folded, generally tubular configuration. The individual sleeves are next joined to the flexible web in spaced apart relationship longitudinally of the flexible web, transversely of the longitudinal axis of the flexible web. The spacing between individual sleeves corresponds to the length of each of the bottom-gusseted packages being formed. Notably, as will be further described, in some of illustrated embodiments each individual sleeve eventually forms the bottom gusset of one package, and the top sleeve portion of an adjacent one of the packages being formed. In other embodiments, packages are formed such that each individual sleeve is positioned within a respective package, and does not span or extend between adjacent packages. Efficient formation is thus promoted.

After the individual sleeves are joined to the flexible web, the flexible web is folded and joined along lateral margins thereof to form a generally tubular, folded flexible web. The individual sleeves are positioned generally within the folded flexible web, in spaced apart relationship. Folding of the flexible web material forms a package body for each of the bottom-gusseted packages, with each package body including a front package panel and a rear package panel joined at opposite side margins thereof.

Next, the folded flexible web is cut at intervals each corresponding in length to the length of each of the bottom-gusseted packages being formed. By this cutting step individual packages are formed so that each individual sleeve provides a bottom gusset for each one of the packages.

In some of the illustrated embodiments, the cutting step includes cutting through each of the individual sleeves positioned within the folded flexible said cutting step includes cutting through each of said individual sleeves so that a portion of each individual sleeve provides: (1) the bottom gusset for one of the packages being formed, and (2) a top sleeve portion for an adjacent one of said packages being formed. Alternatively, the individual sleeves are positioned generally within the folded, flexible web, with the individual sleeves providing the bottom gusset for a respective one of the packages being formed.

Efficient package formation is promoted by configuring each of the individual sleeves to have a length which is less than the width of the folded web of flexible material. This facilitates formation of the bottom gusset with a width less than the width of the package, which desirably permits formation of side seals between the front and read package panels of each package at opposite side edges of the bottom gusset of the package. Each of these side seals overlaps a respective end of the bottom gusset of the package. Such side seals can be formed of a sufficient width to permit the package to be readily self-standing and stable.

In accordance with the illustrated embodiments, the present method includes joining each of the individual sleeves to the folded flexible web prior to the step of cutting the folded flexible web.

In accordance with one illustrated embodiment, each top sleeve portion is provided with a recloseable fastener positioned within the respective top sleeve portion. Each recloseable fastener comprises a pair of fastening elements respectively joined to confronting inside surfaces of each top sleeve portion. The fastener elements may comprises profile fastener elements, adhesive fastener components, hook-and-loop style fastener components, "unisex" self-engaging fastener components, and other releasable fastener arrangements as are known in the art.

In another embodiment, each top sleeve portion is provided with an upper seal for closing a respective one of the packages being formed. In the presently preferred practice of this embodiment, the upper seal is formed between inturned edges of the respective top sleeve portion.

As noted, the present method can be practiced such the step of folding the flexible web of material which forms the packages includes folding the flexible web generally at the longitudinal axis thereof, so that each of the individual sleeves extends generally between the longitudinal axis and the joined lateral margins of the flexible web of material. The resultant bottom gusset for each package thus extends generally between the longitudinal axis and the joined lateral margins at the seam at which the web of material is joined to itself, and the side edge of the package. Alternatively, the web of material can be folded and joined to itself such the package seam is positioned in the rear package panel.

An important aspect of the preferred practice of the invention promotes efficient, high-speed formation. Specifically, the present method includes intermittently advancing flexible web of material after the individual sleeves have been joined thereto, wherein the flexible web of material is advanced with a tolerance range of dimension $T_{LD}$. This tolerance range is dependent upon the specific operational parameters of the forming apparatus, such as the associated form, fill, and seal machine. Notably, the present method includes forming top and bottom end seals in adjacent ones of the packages being formed by operation of a pair of heat sealing jaws, wherein the spacing between the ends seals of adjacent ones of the packages is at least two times $T_{LD}$. This ensures proper sealing of the ends of each package, with each bottom gusset properly sealed and configured to open or splay for providing the desired interior volume to the package, and desired self-standing characteristics. This spacing can further be selected to accommodate the range in variation of the longitudinal positioning of each of the individual sleeves on the flexible web of material.

As noted, it is presently contemplated that the folded sleeve-forming web from which the bottom gussets are formed has an inside surface of which does not heat-seal to itself. Since package formation, and advancement through the form, fill and seal machine can sometimes orient the bottom gusset in the "leading" direction, in can be desirable to close the individual sleeves against opening during such advancement. This can be achieved by closing each of the individual sleeves prior to joining the individual sleeves to the flexible web of material by temporarily joining an inside surface of each of individual sleeves.

Thus, a recloseable package configured in accordance with the present comprises a package body formed from a flexible web having a longitudinal axis, with the flexible web being folded to define a front package panel and a rear package panel of said package body. The front and rear package panels are joined to each other at respective lateral side margins of the package body, with the flexible web being joined to itself along a seam which extends parallel to the longitudinal axis of the flexible web.

The present package further includes a bottom gusset positioned between the front and rear package panels, with the bottom gusset extending less than the width of the front and rear package panels. Laterally opposite side seals, that join the front and read package panels to each other at the respective lateral side margins of said package body, each overlap a respective end of said bottom gusset.

In one embodiment, the flexible web from which the package body is formed is folded generally at the longitudinal axis thereof, with bottom gusset extending generally between the longitudinal axis, and the joined lateral margins at the package seam at which web of material is joined to itself. Alternatively, the seam at which the web of material is joined to itself is positioned in the rear package panel.

Other features and advantages of the present invention will become readily apparent from the following detailed description, the accompanying drawings, and the appended claims.

DESCRIPTION OF THE PREFERRED EMBODIMENT

Figure 1:
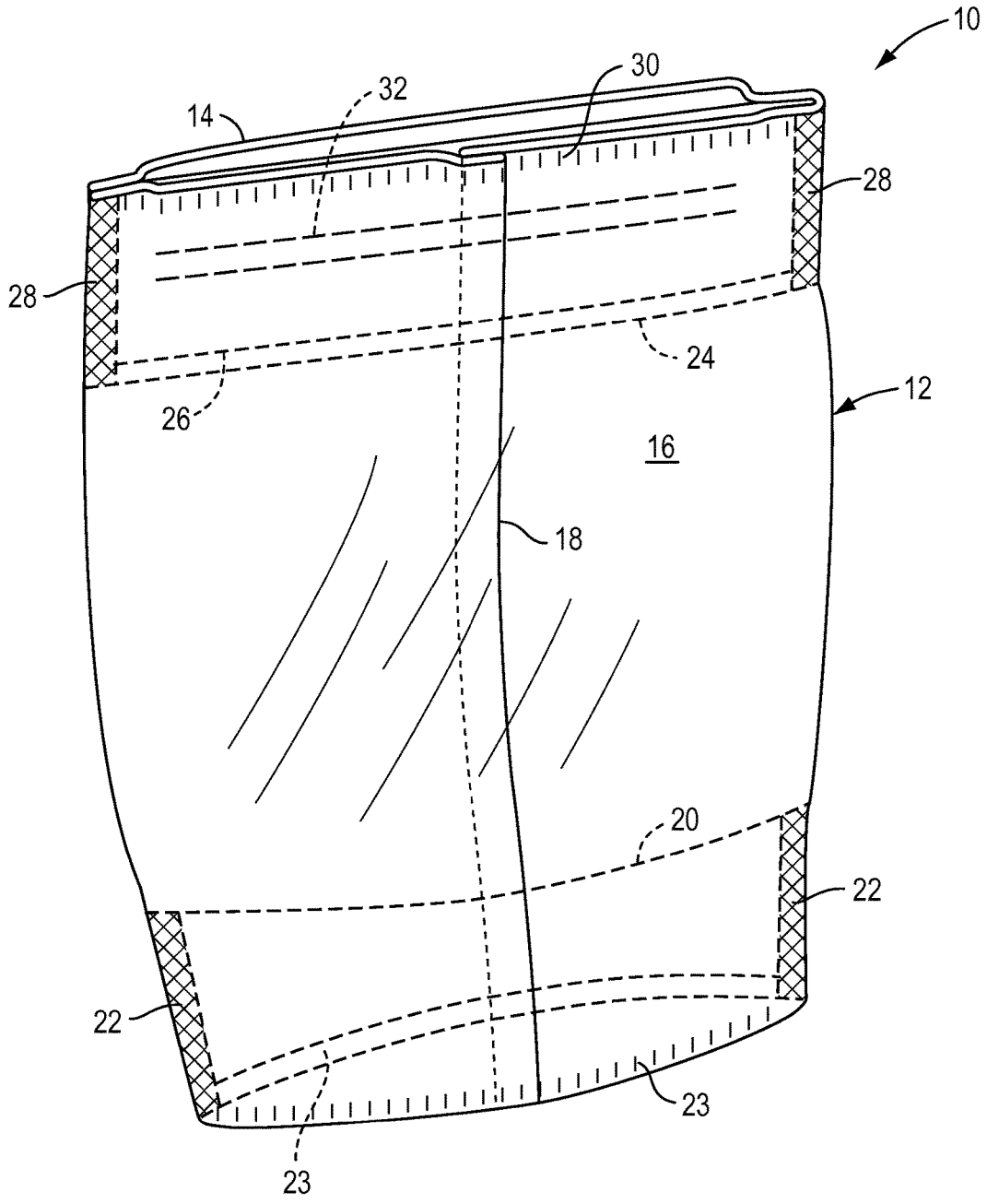
FIG. 1 is a perspective view of a bottom-gusseted package, configured as a recloseable package, embodying the principles of the present invention.

While the present invention is susceptible of embodiment in various forms, there is shown in the drawings and will hereinafter be described the presently preferred embodiments, with the understanding that the present disclosure should be considered as an exemplification of the invention, and is not intended to limit the invention to the specific embodiments illustrated.

U.S. Pat. Nos. 4,909,017, 4,617,683, 5,902,047, 6,971,794, and 8,182,407, illustrate various package constructions and formation methods, and are all hereby incorporated by reference.

Figure 2:
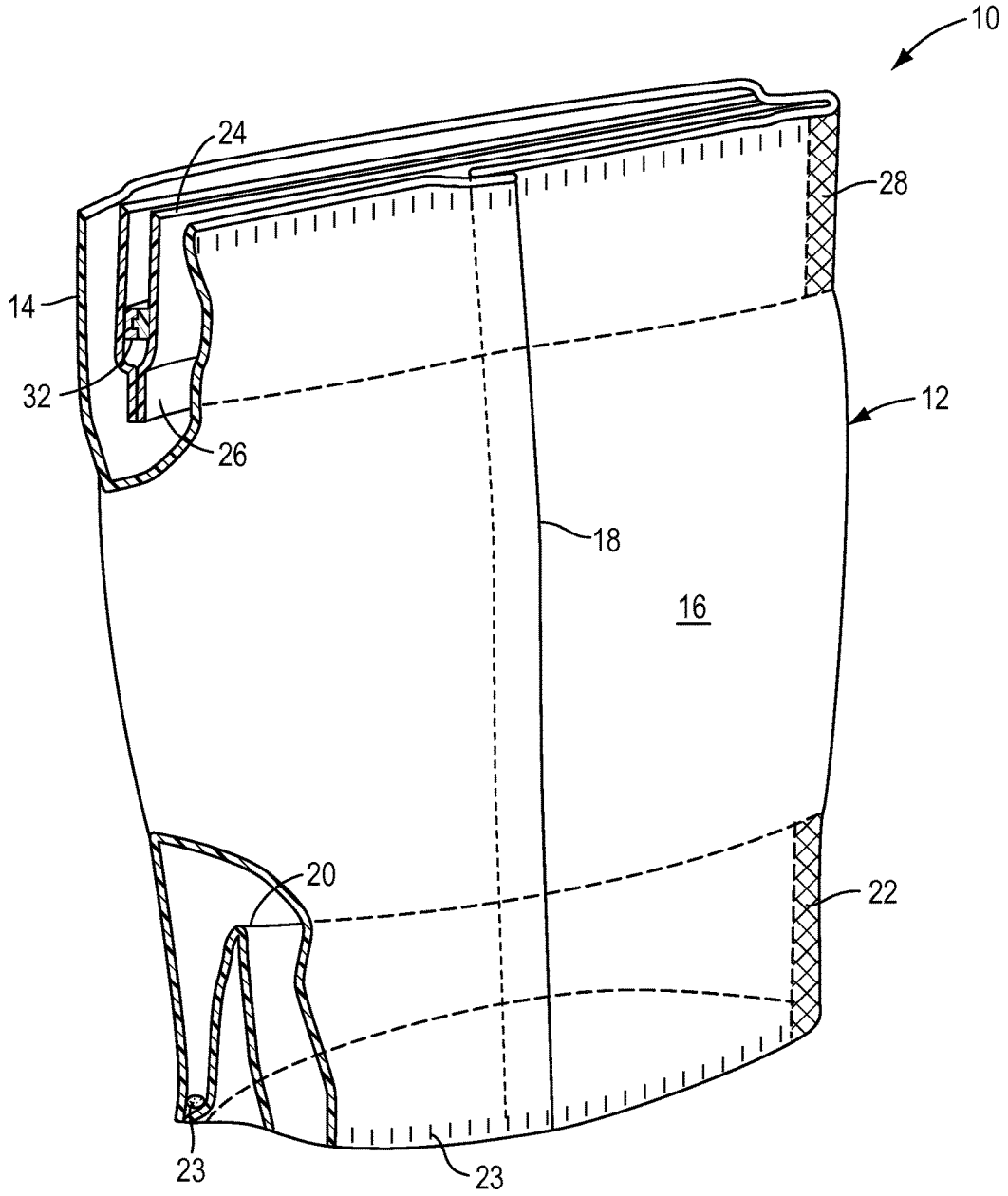
FIG. 2 is a perspective view similar to FIG. 1, with portions of the package cut away to illustrate the bottom gusset and recloseable fastener of the package.
Figure 3:
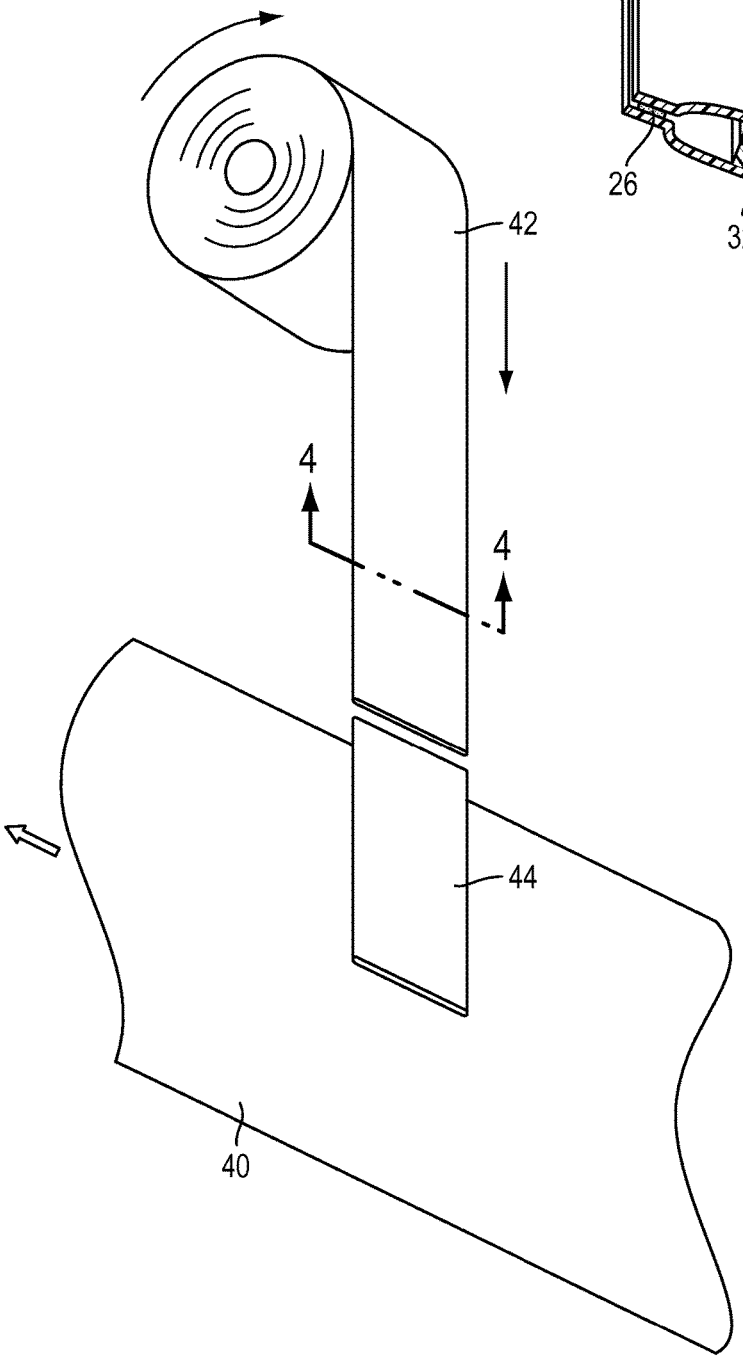
FIG. 3 is a diagrammatic view illustrating formation of the package shown in FIGS. 1 and 2, in accordance with the present invention.

With reference first to FIGS. 1 and 2, therein is illustrated a bottom-gusseted package 10 embodying the principles of the present invention. As will be further described, bottom-gusseted package 10 is configured to facilitate formation and filling on an associated, so-called form, fill and seal packaging machine, as is known in the art. Typically, the present invention can be practiced by partial formation of the present package as a rolled web of flexible, polymeric film material, with individual sleeves positioned thereon, which is supplied to the form, fill and seal apparatus. The formation of each package is completed attendant to filling of each of the packages with the desired quantity of product.

In this embodiment, bottom-gusseted package 10 is configured as a recloseable package, and includes a recloseable fastener at an upper portion of the package. Notably, and as will be further described, package 10 is formed by joining a plurality of individual sleeves to an associated web of flexible material, in spaced apart relationship along the longitudinal axis of the flexible web. Attendant to package formation, each individual sleeve can be cut as individual packages are formed, with each individual sleeve providing a bottom gusset in one package, and a top sleeve portion, including a recloseable fastener, and/or other package features, in an adjacent one of the packages being formed. However, as will be further described, the present invention can be practiced without cutting of the individual sleeves, which are configured to provide a bottom gusset for each package being formed.

With further reference to FIGS. 1 and 2, the bottom-gusseted package 10 illustrated therein includes a package body 12 formed from a flexible film web having a longitudinal axis, wherein the flexible web has been folded to define a front package panel 14 (shown facing rearwardly in FIGS. 1 and 2) and a rear package panel 16 of the package body 12. The front and rear package panels 14 and 16 are joined to each other at respective lateral side margins of the package body 12. In the illustrated embodiment, the front and rear package panels are joined to each other where the flexible film web from which the body is formed has been folded. The flexible film web from which the package body 12 is formed is joined to itself along a longitudinal seam 18 which extends parallel to the longitudinal axis of the flexible web. While seam 18 has been illustrated generally at the middle of rear package panel 16, the flexible web can otherwise be joined to itself, such as at along one of the lateral side margins of the package body.

In accordance with the present invention, package 10 includes a bottom gusset 20 which is positioned between the front and rear package panels 14 and 16, and which extends upwardly and inwardly from lower edges of the front and rear package panels. As will be further described, the pleat-like bottom gusset 20 is formed from a sleeve of material which is positioned within the flexible web from which the package body is formed, with the sleeve of material cut attendant to formation of individual packages.

The bottom gusset 20 is joined to and integrated with the package body by a pair of side seals 22 at opposite lateral margins of the package body, and a pair of end seals 23 which respectively join the edges of the bottom gusset 20 to the front and rear package panels 14 and 16. It is presently contemplated that the bottom gusset 20 be configured to have a width less than that of the package 10, which permits the formation of side seals to join the front and rear package panels to each other. This permits the formation of a stable and self-standing package, by closing the opposite ends of the bottom gusset. This can be desirable if the inwardly facing surfaces of the bottom gusset do not heat-seal to each other. In previous bottom gusseted packages, the bottom gusset typically extends the full width of the package, so that the length of the gusset is same as the width of the front and rear package panels.

In accordance with this illustrated embodiment, the bottom-gusseted package 10 is configured for recloseable use. To this end, the package 10 includes a top sleeve portion 24 positioned between the front and rear package panels 14 and 16, at the upper end of the package body 12. The top sleeve portion 24 preferably includes a sleeve seal 26, which may be configured as a so-called "peel seal", or otherwise configured for separation attendant to initial opening of the package. The top sleeve portion 24 can be otherwise configured to permit access to the contents of the package through the top sleeve portion, such as by the provision of a preferentially weakened region. The top sleeve portion 24 is joined to and integrated with the package body 12 by side seals 28 joining respective opposite ends of the sleeve portion 24 to the package body generally at opposite, lateral side margins thereof. A pair of top seals 30, respectively join the pair of legs or flanges of the top sleeve portion 24 to the front and rear package panels 14, 16.

In this embodiment, the top sleeve portion 24 includes a recloseable fastener 32. The recloseable fastener includes first and second fastener elements configured for releasable securement to each other, with the fastener elements respectively joined to the legs or flanges of the top sleeve portion 24. Thus, the sleeve portion 24 provides first and second mounting flanges for the first and second fastener elements, with the flanges respectively positioned inwardly of and joined to the front and rear package panels.

As will be appreciated, access to the contents of the package 10 is provided via the top sleeve portion 24 and recloseable fastener 32. For opening, the legs or flanges of the top sleeve portion 24 are separated, and the first and second fastener elements of the recloseable fastener 32 separated. For initial opening of the package, the sleeve seal 26 is opened and separated, with access to the interior of the package 10 thus provided. By merely pressing the sleeve portion 24 together, and urging the components of the recloseable fastener 32 together, the package 10 can be easily reclosed. As illustrated in FIGS. 6*a*-6*c*, for some applications in can be desirable to provide and an additional sleeve seal 27, positioned on the side of the fastener 32 generally opposite sleeve seal 26. Sleeve seal may also comprise a so-called "peal seal", and is eventually positioned between the mounting flanges for the fastener 32 provided by the opposite legs of the legs of the sleeve portion 24. Sleeve seal 27 can provide tamper-evidence to provide visually discernible evidence of the initial opening to the recloseable package 10.

Recloseable fastener 32 preferably comprises a pair of interlocking profile fastener elements. Such fastener elements may be identically configured, or complementary. Adhesive fastener components, hook-and-loop fastener components, "unisex" self-engaging fastener components, or like recloseable fastening arrangements can be employed for the recloseable fastener 32.

For package formation, a flexible web 40 preferably comprising heat-sealable polymeric material is provided, with a flexible web typically advanced in a direction along its longitudinal axis web 40. Formation of the present bottom-gusseted package is further effected by providing a flexible, sleeve-forming web 42, also preferably comprising suitable polymeric, heat-sealable material. The composition of the sleeve-forming web can differ from the flexible web 40 for forming the package of the body, as may be desired. By way of example, the sleeve-forming material can be selected to exhibit certain gas permeability characteristics, or even be perforated, which can be desirable for some types of packaging. Perforated plastics allow gas exchange and prevent excess humidity, while solid plastics create a better product seal for modifying atmosphere and reducing available oxygen respiration and ripening, thus extending product shelf life.

It is presently contemplated that only one side of the sleeve-forming web be heat-sealable, so that the inside surface of the folded, sleeve-forming web does not heat seal to itself. This permits the eventual opening and spreading of the legs of the bottom gusset 20 so that the package 10 can assume a generally self-standing orientation.

Figure 4:
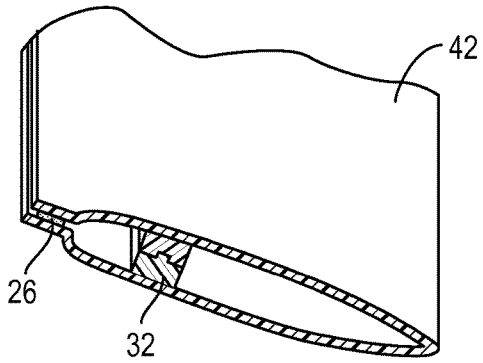
FIG. 4 is a cross-sectional view taken generally along lines 4-4 of FIG. 3.

As shown on FIG. 4, the sleeve-forming web 42 may be provided with a tubular configuration, including the sleeve seal 26 releasably joining lateral edges of the sleeve-forming web. In this embodiment, the sleeve-forming web is provided with recloseable fasteners 32, which may be provided in either continuous form, or as segmented, pre-cut lengths. As illustrated, the recloseable fastener elements are positioned generally within the sleeve-forming web 42, preferably in interconnected relationship.

As further illustrated, individual sleeves 44 are cut from the sleeve-forming web 42, and are positioned transversely of the longitudinal axis of the flexible web 40 from which the package body is formed. For some applications, it can be desirable to seal the ends of each individual sleeve 44, such as with suitable adhesive. The individual sleeves 44 are joined to the flexible web 40 in spaced apart relationship longitudinally of the web 40. The spacing between the individual sleeves 44 corresponds to the length of each of the bottom-gusseted packages 10 being formed. The ends of each sleeve 44 are joined, such as by heat-sealing, to the web 40, by end seals 43 (FIG. 6*a*.) Transverse seals 45 can also be formed between the web 40 and the sleeve 44 extending generally parallel to fastener 32 along opposite side margins thereof (FIG. 6*b*.)

Figure 5:
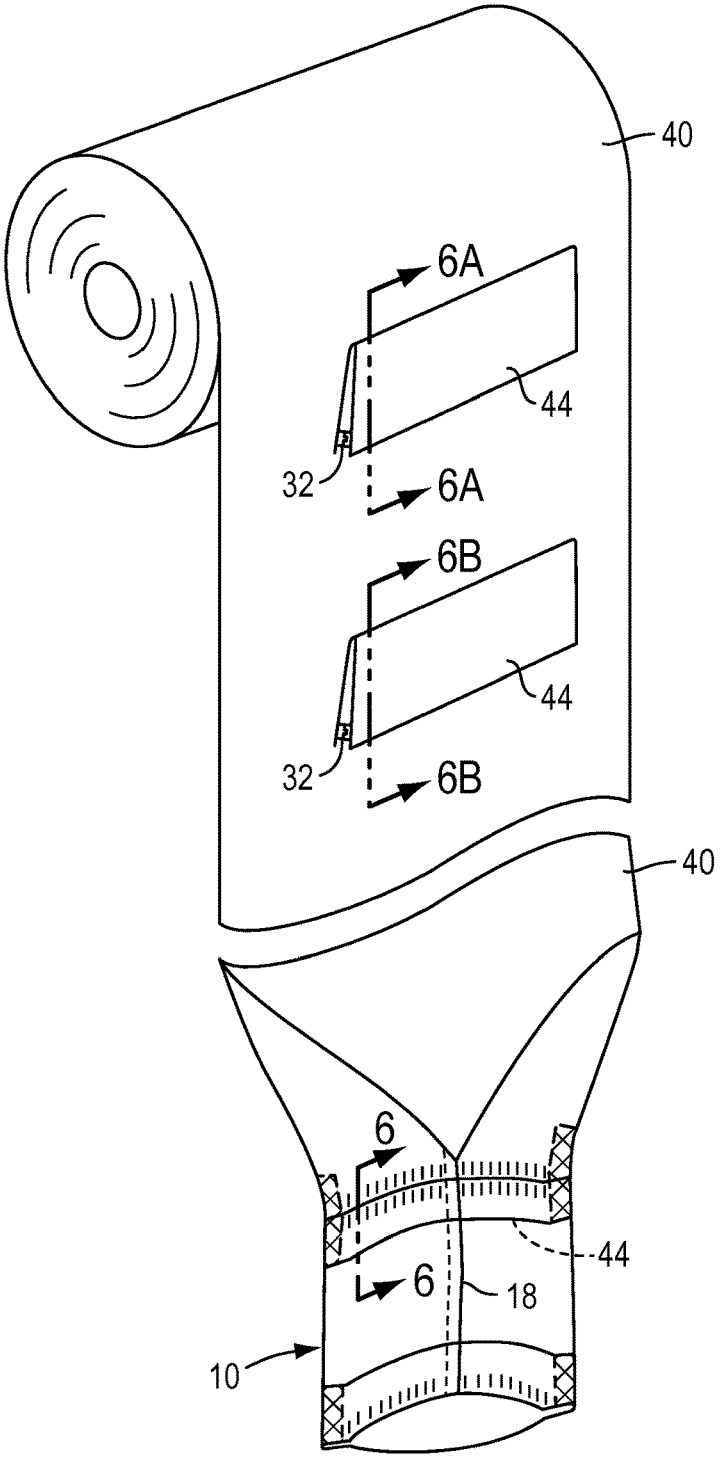
FIG. 5 is a diagrammatic view further illustrating formation of a recloseable, bottom-gusseted package.
Figure 6:
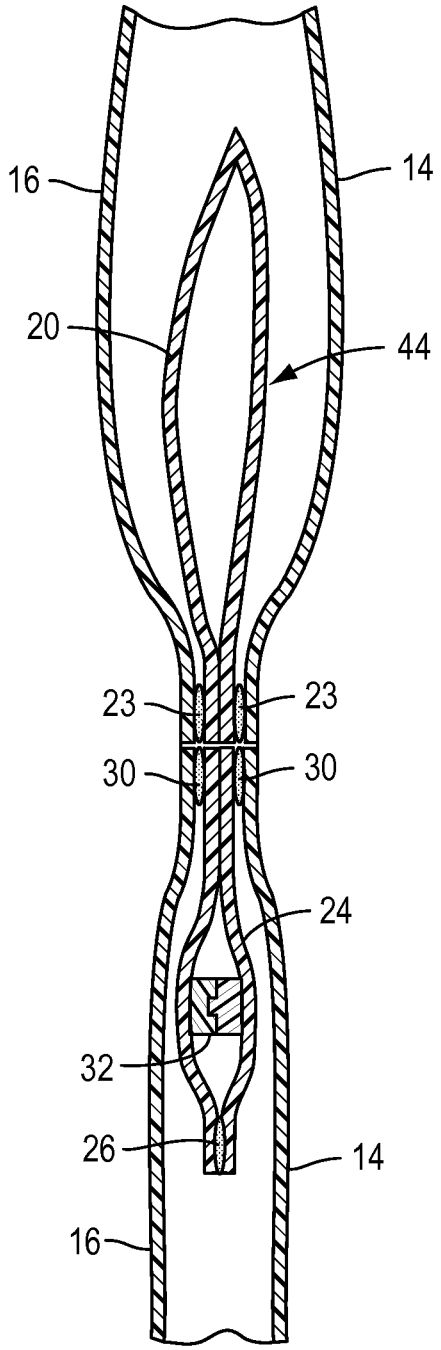
FIG. 6 is a cross-sectional view taken generally along lines 6-6 of FIG. 5.
Figure 6A:
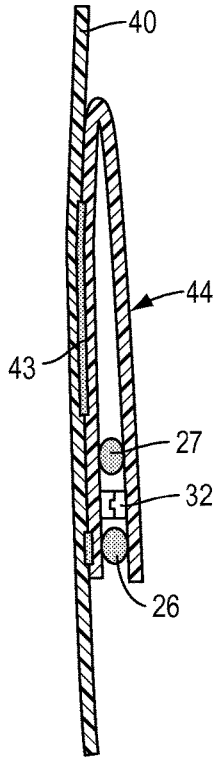
FIG. 6*a* is a cross-sectional view taken generally along lines 6*a*-6*a* of FIG. 5.
Figure 6B:
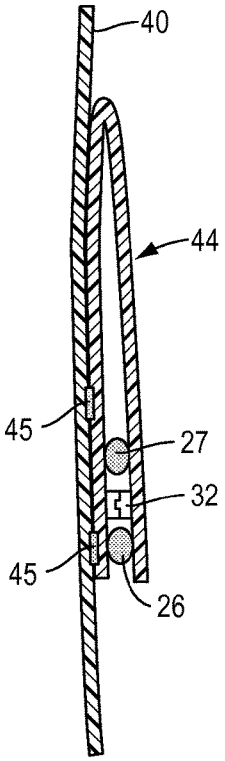
FIG. 6*b* is a cross-sectional view taken generally along lines 6*b*-6*b* of FIG. 5.
Figure 6C:
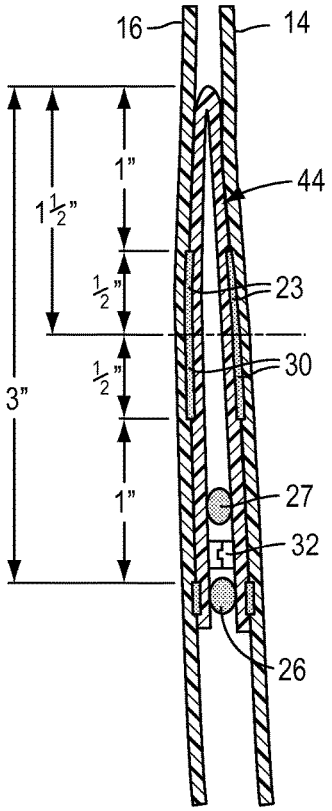
FIG. 6*c* is a cross-sectional view similar to FIG. 6.

After each of the individual sleeves 44 is joined to the flexible web 40, the flexible web is folded and the lateral margins thereof joined together to form a folded flexible web (see FIGS. 5 and 6). In this way, a package body is formed for each of the bottom-gusseted packages. By folding of the flexible web 40, the front and rear package panels 14 and 16 of each package are formed. The folded flexible web 40 can be joined to itself so as to form bag seam 18, with the front and rear package panels joined to each other at the folded, lateral margins of the folded web. As illustrated, the individual sleeves 44 are positioned within the folded flexible web 40.

Figure 7:
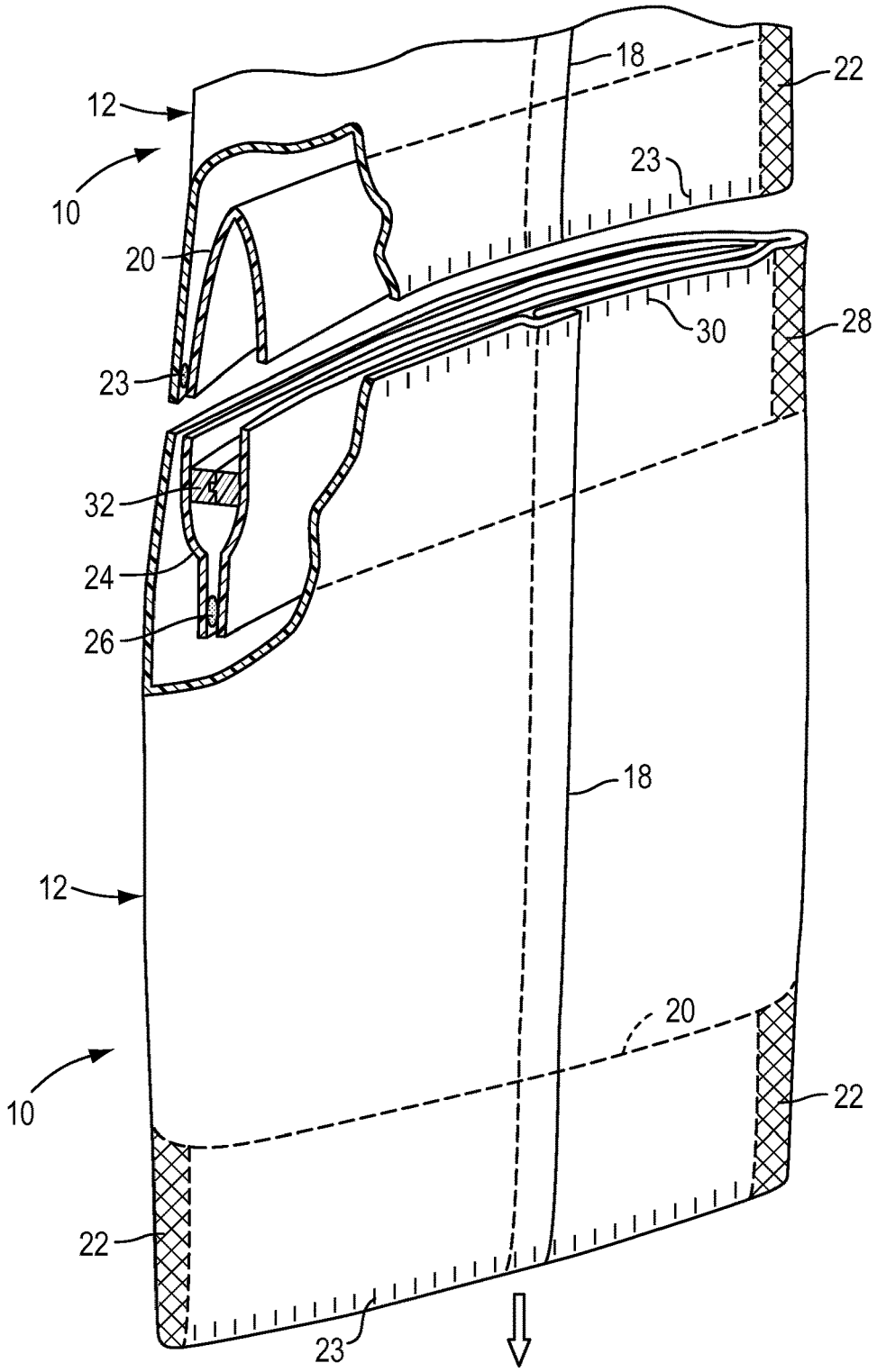
FIG. 7 is a diagrammatic view further illustrating formation of the present package, including cutting into individual packages.

Notably, the present invention contemplates that in this embodiment, each individual sleeve 44 spans and extends between two adjacent ones of the packages being formed, with subsequent cutting of the flexible web into individual packages resulting in each individual sleeve 44 providing a bottom gusset 20 for one package, and a top sleeve portion 24 for an adjacent one of the packages. FIG. 6 illustrates the manner in which each individual sleeve 44 extends between adjacent ones of the packages, with FIG. 7 illustrating cutting of the folded flexible web 40 transversely of its longitudinal axis to form individual packages, including cutting through each sleeve portion 44 to form a bottom gusset 20 for one package, and a top sleeve portion 24 for an adjacent package. It is presently contemplated that formation in this manner can be effected, if desired, during packaging on a form, fill, and seal machine, or that individual packages can be formed for subsequent filling. Depending upon the specific formation technique, side seals 22 and 28 are typically formed prior to filling, with one of end seals 23, 30 formed after the contents of each package have been positioned therein.

FIG. 6*c* illustrates an example of dimensioning of the bottom gusset of the present package, and the manner is which it is configured to accommodate the typical operating parameters of a vertical form, fill and seal machine. As will be recognized by those familiar with the art, this type of machine intermittently advances packaging material through the machine, with typical variation with respect to the web-cutting apparatus being plus/minus 0.25 inches. Thus, as shown in FIG. 6*a*, a typical sleeve portion 44 can be provided with a folded width of approximately 3 inches, with seals formed joining each sleeve portion 44 to the web 40. These seals would typically each have a 1.0 inch dimension. When the web is cut, the cut can be formed at the center of this 1.0 inch seal, so that seals each having a width of 0.5 inches are formed. However, because of the typical variation in the operation of the apparatus, i.e. plus/minus 0.25 inches, the exact dimensions of the bottom gusset 20 and top sleeve portion 24 can vary from one package to another. As will be appreciated, this dimensioning is meant to be illustrative, but it will be recognized that the present invention can readily be practiced to accommodate this typical cutting position variation of a vertical form, fill and seal machine.

With reference now to FIG. 8-11, therein is illustrated a further alternate embodiment of the present bottom-gusseted package, designated 110. In most respects, bottom-gusseted package 110 is like the previously-described package 10, with the exception that the top sleeve portion 124 of each package is configured to provide an upper package seal instead of a recloseable fastener assembly. In this embodiment, elements corresponding to the previously described package 10 are designated by like reference numerals in the 100-series.

With reference now to FIG. 8-11, the bottom-gusseted package 110 illustrated therein includes a package body 112 formed from a flexible film web having a longitudinal axis, wherein the flexible web has been folded to define a front package panel 114 (shown facing rearwardly in FIGS. 12 and 13) and a rear package panel 116 of the package body 112. The front and rear package panels 114 and 116 are joined to each other at respective lateral side margins of the package body 112. In the illustrated embodiment, the front and rear package panels are joined to each other where the flexible film web from which the body is formed has been folded. The flexible film web from which the package body 112 is formed is joined to itself along a longitudinal seam 118 which extends parallel to the longitudinal axis of the flexible web. While seam 118 has been illustrated generally at the middle of rear package panel 116, the flexible web can otherwise be joined to itself, such as at along one of the lateral side margins of the package body.

In accordance with the present invention, package 110 includes a bottom gusset 120 which is positioned between the front and rear package panels 114 and 116, and which extends upwardly and inwardly from lower edges of the front and rear package panels. As previously described, the pleat-like bottom gusset 120 is formed from a sleeve of material which is positioned within the flexible web from which the package body is formed, with the sleeve of material cut attendant to formation of individual packages.

The bottom gusset 120 is joined to and integrated with the package body by a pair of side seals 122 at opposite lateral margins of the package body, and a pair of end seals 123 which respectively join the edges of the bottom gusset 20 to the front and rear package panels 114 and 116.

The package 110 further includes a top sleeve portion 124 positioned between the front and rear package panels 114 and 116, at the upper end of the package body 112. The top sleeve portion 124 preferably is provided with an upper seal 125, preferably formed between inturned edges of the upper sleeve portion 124. This seal 125, may be configured as a so-called "peel seal", or otherwise configured for separation attendant to initial opening of the package. The top sleeve portion 124 can be otherwise configured to permit access to the contents of the package through the top sleeve portion, such as by the provision of a preferentially weakened region. The top sleeve portion 124 is joined to and integrated with the package body 112 by side seals 128 joining respective opposite ends of the sleeve portion 124 to the package body generally at opposite, lateral side margins thereof. A pair of top seals 130, respectively join the pair of legs or flanges of the top sleeve portion 124 to the front and rear package panels 114, 116.

Figure 8:
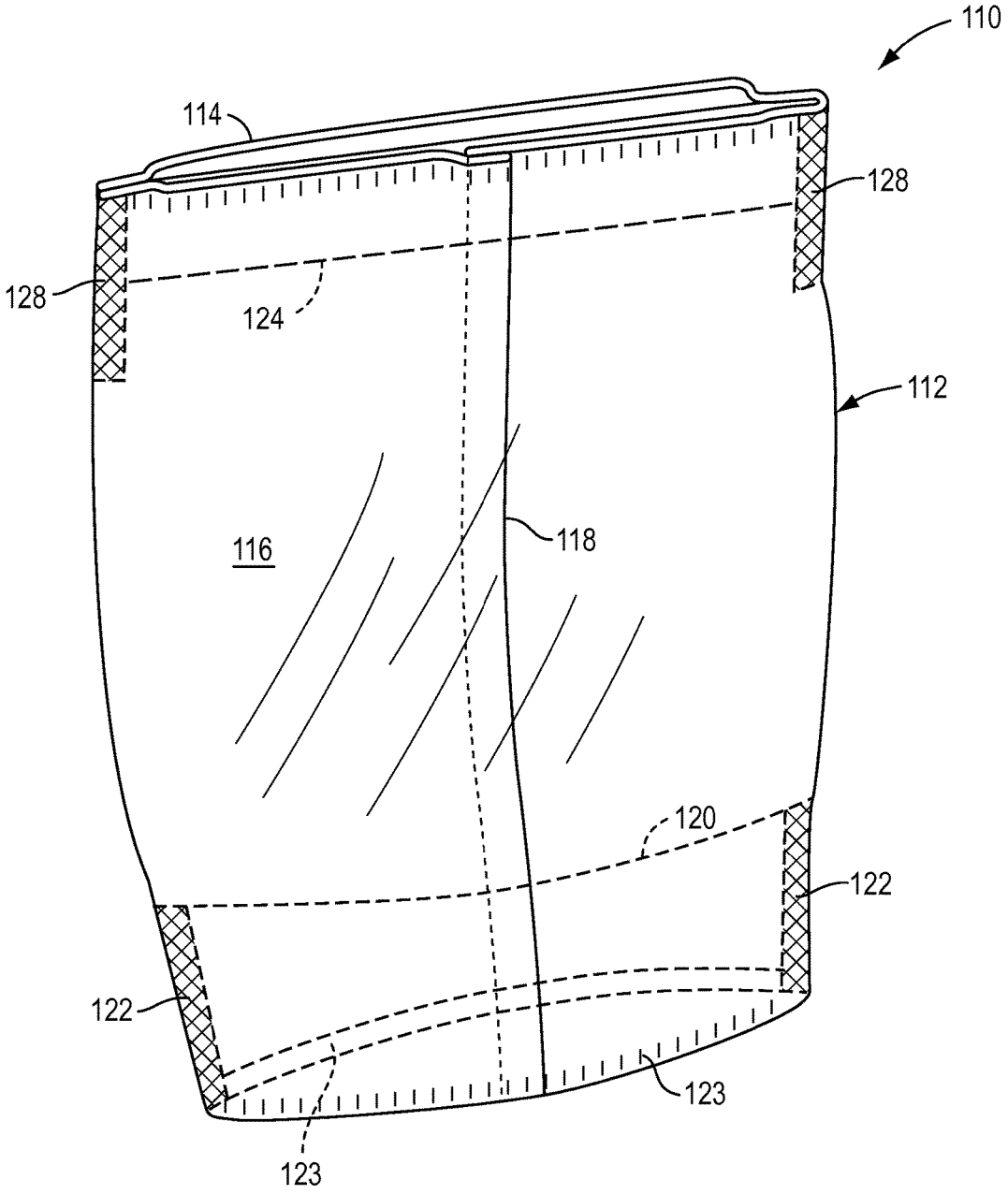
FIG. 8 is a perspective view of a further embodiment of a bottom-gusseted package, including an upper package seal, configured in accordance with the present invention.
Figure 9:
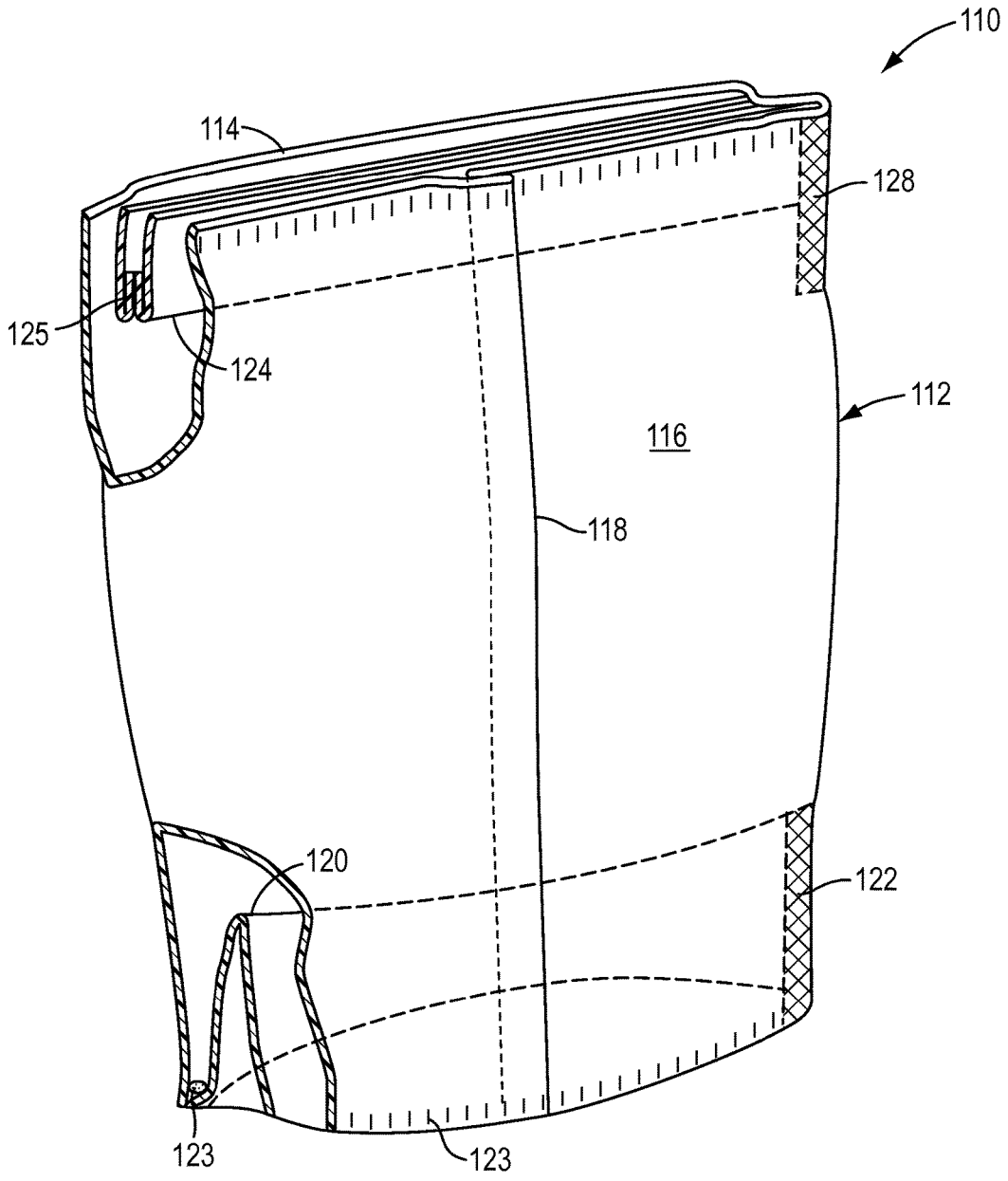
FIG. 9 is a perspective view, partially cut away, of the embodiment of the bottom-gusseted package shown in FIG. 12.
Figure 10:
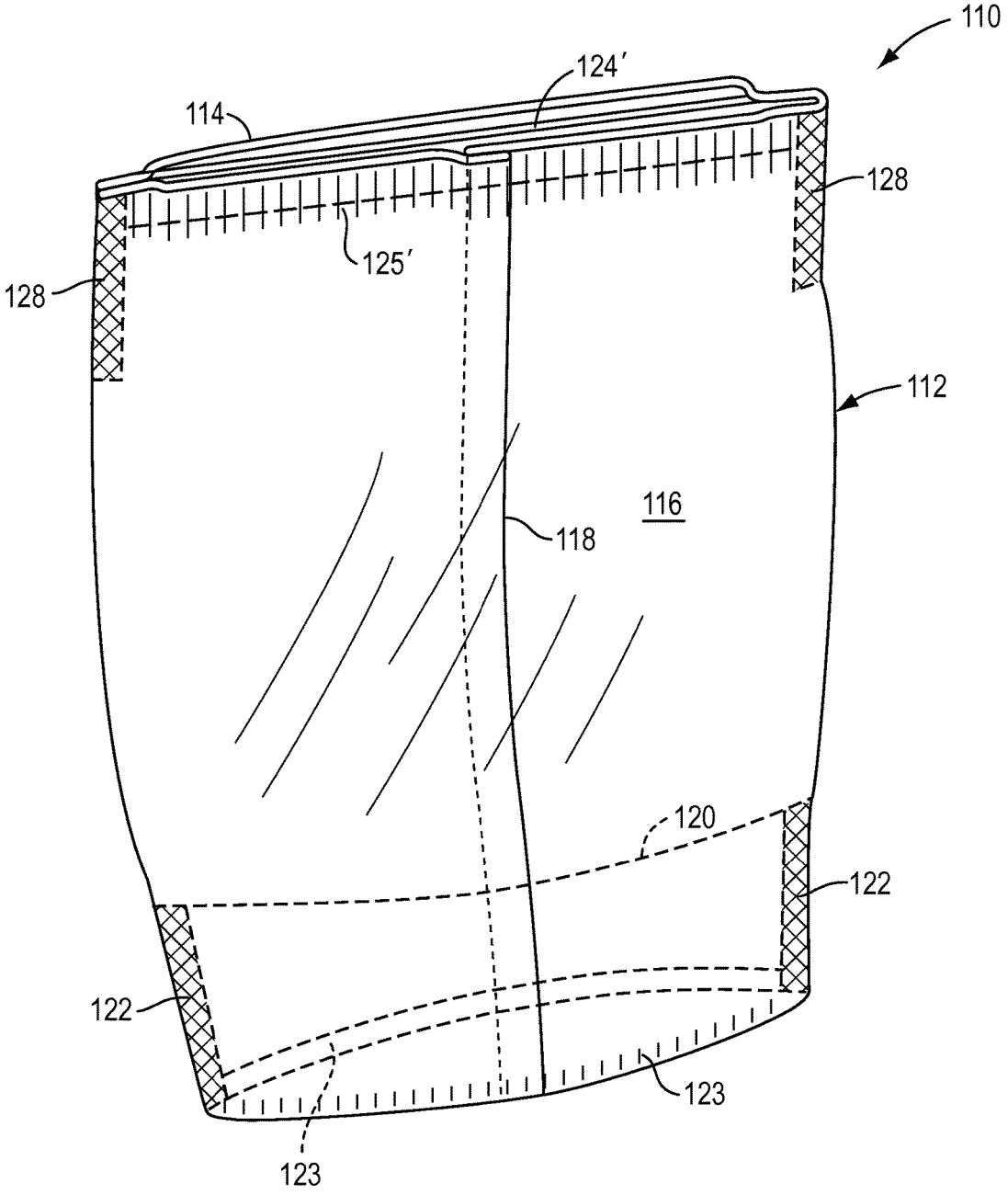
FIG. 10 is a perspective view of a further embodiment of a bottom-gusseted package, including an upper package seal, configured in accordance with the present invention.
Figure 11:
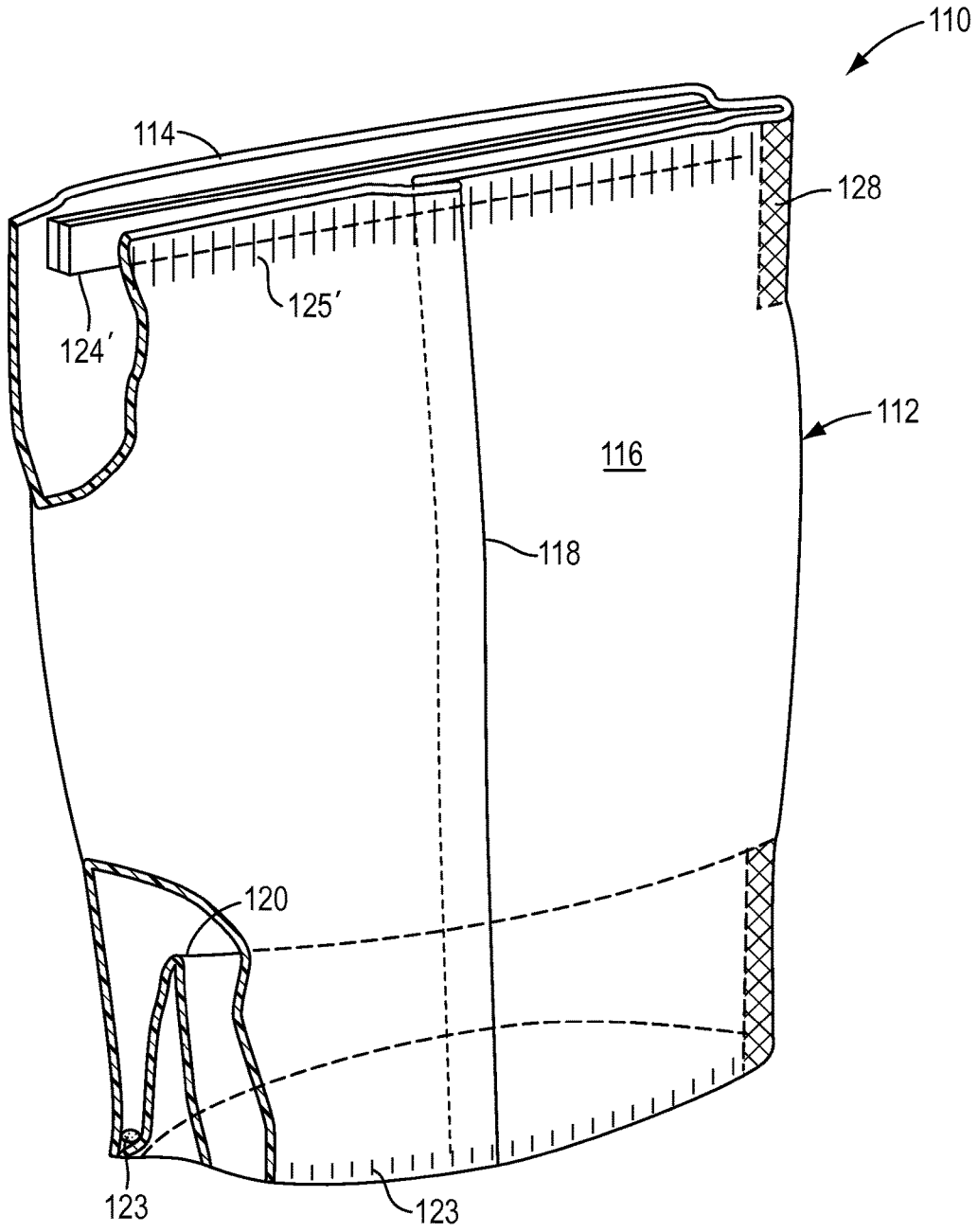
FIG. 11 is a perspective view, partially cut away, of the embodiment of the bottom-gusseted package shown in FIG. 14.

FIGS. 10 and 11 illustrate a modified form of the embodiment of the present bottom-gusseted package illustrated in FIGS. 8 and 9. In this modified form of the package 110, the package includes a bottom gusset 120, but includes a modified top sleeve portion 124' which is positioned above an end seal 125' of the package formed by joining the front and rear package panels 114, 116 to each other. By virtue of the top sleeve portion having a width less than the width of the package, side seals 128 are provided at respective opposite ends of the sleeve portion 124'.

Figure 14:
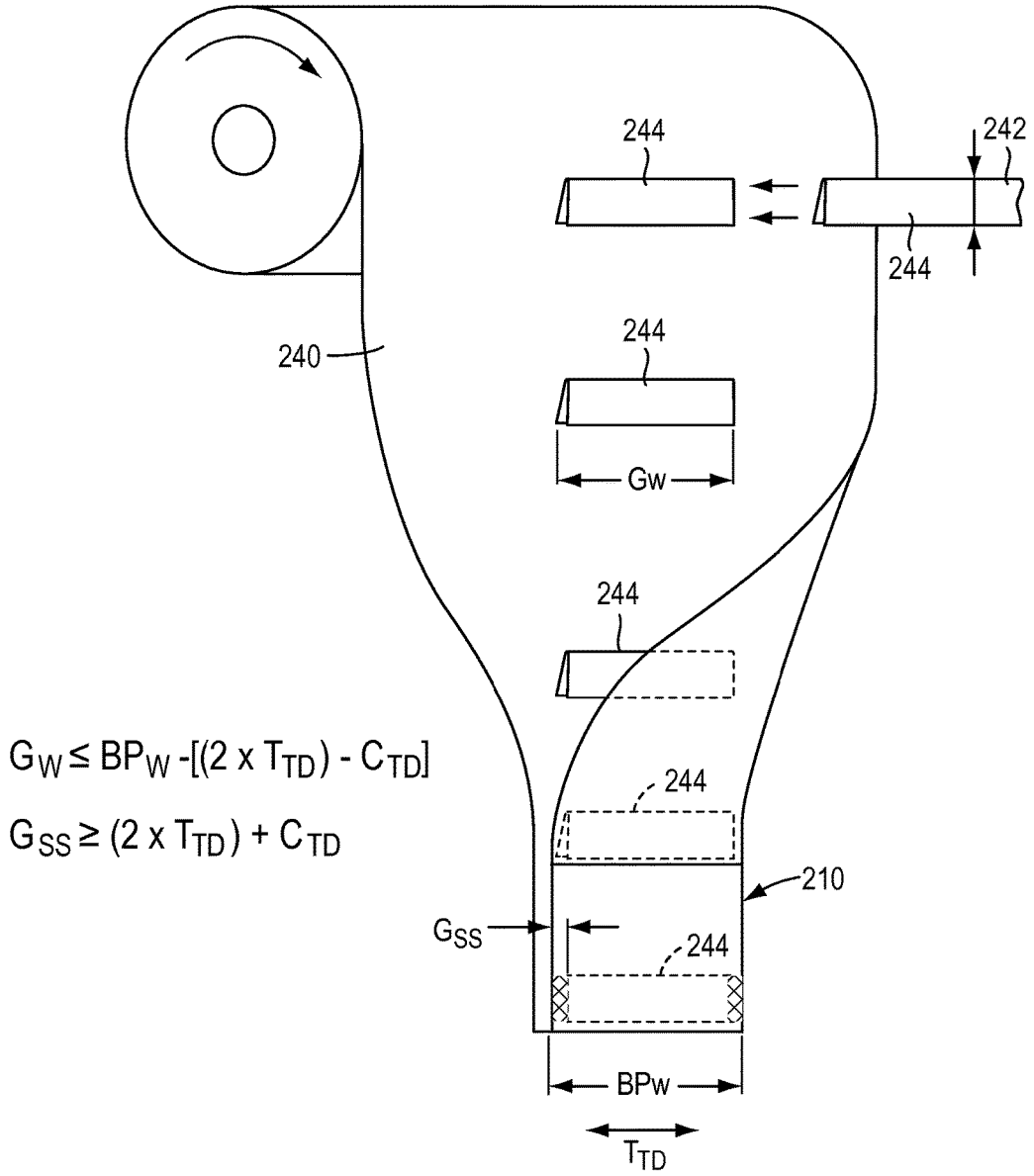
FIG. 14 is a diagrammatic view illustrating formation of the package shown in FIGS. 12 and 13, in accordance with the present invention.
Figure 15:
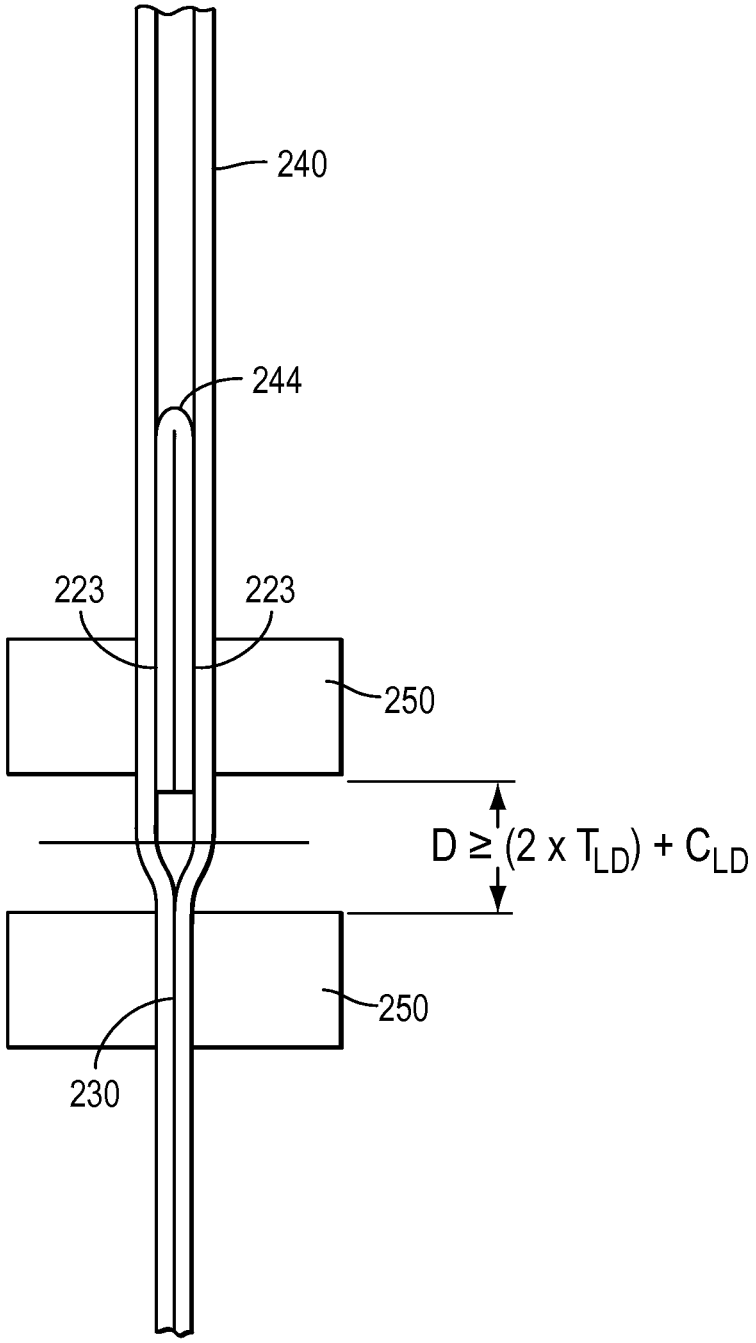
FIG. 15 is a diagrammatic view further illustrating formation of a recloseable, bottom-gusseted package.

This form of the present package can be formed attendant to formation of a package having a bottom gusset, without the need to form a top gusset or other structure at the top of the package. Given the normal manufacturing variations noted above on a vertical form, fill and seal apparatus, formation of a packages with bottom gussets only could in some instances result in packages have a sleeve portion 124' such as illustrated in FIGS. 14 and 15. Specifically, in some instances, the individual sleeve forming the bottom gusset of the package would be positioned so that the sleeve would not be cut, and no portion of the sleeve would extend from the bottom gusset of one package to provide a sleeve portion of an adjacent package after cutting of individual packages. In other instances, the individual sleeve would be positioned so that cutting results in formation of the desired bottom gusset for one package, with a top sleeve portion such as 124' formed in an adjacent package. The top sleeve portion 124' is confined generally within the end seal formed by side seals 128, and end seal 125' joining the front and rear package panels below the end of sleeve material that is in the top seal of the package.

By way of example, using the typical +/−¼" variation of the typical vertical form, fill and seal (VFFS) machine, if each package end seal is ¾", one extreme case would be that the gusset is only in the bottom of one package and no sleeve material in the top of the adjacent package. The other extreme would be having ½" of sleeve material, i.e., top sleeve portion 124', in the top of the adjacent package, but there still would be a ¼" end seal 125' below the sleeve material to seal off the top of the package. The effect is that the top of the package would appear to not have any sleeve material in the top of any of the packages because the end seal would hide it.

With reference now to FIG. 12-15, therein is illustrated a further embodiment of the present bottom-gusseted package, designated 210. In many respects, bottom-gusseted package 210 is like the previously-described package 10. However, package 210 differs in that the package is provided with a bottom gusset but without a top sleeve portion, since formation is preferably effected without cutting the individual sleeves which respectively form the bottom gusset of each package. In this embodiment, elements corresponding to the previously described package 10 are designated by like reference numerals in the 200-series.

Figure 12:
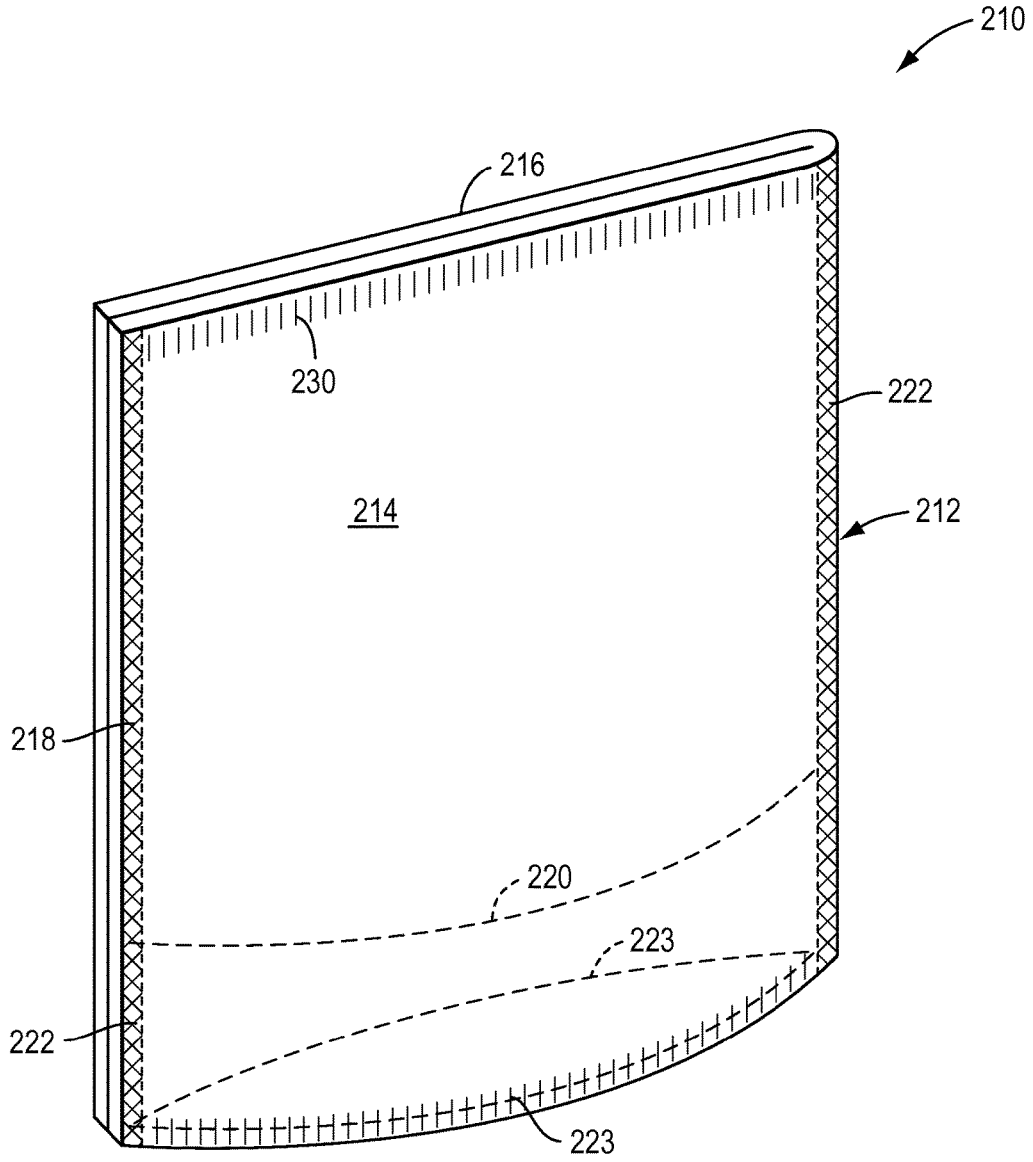
FIG. 12 is a perspective view of another embodiment of a bottom-gusseted package, embodying the principles of the present invention.
Figure 13:
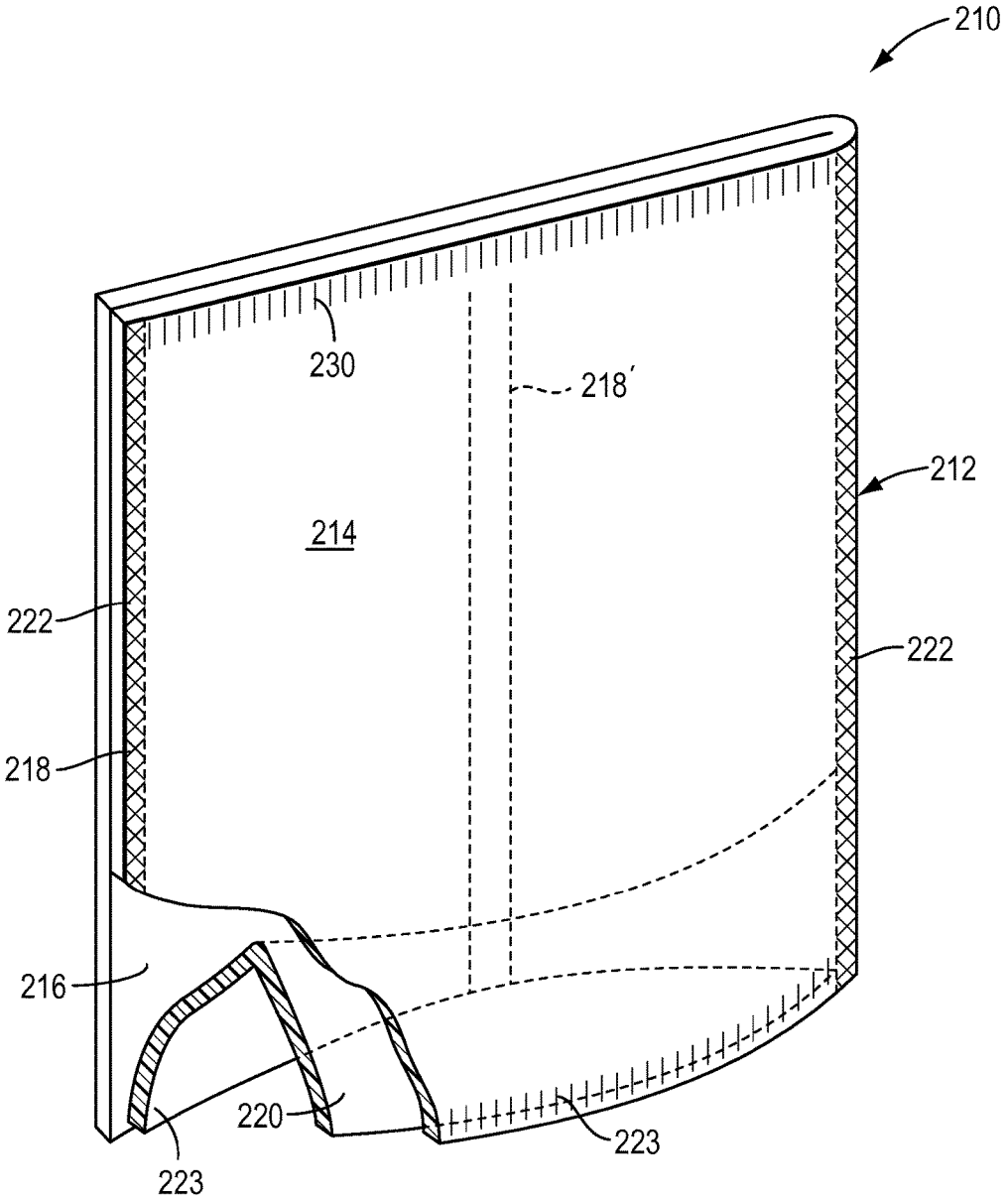
FIG. 13 is a perspective view similar to FIG. 12, with portions of the package cut away to illustrate the bottom gusset of the package.

With further reference to FIGS. 12 and 13, the bottom-gusseted package 210 illustrated therein includes a package body 212 formed from a flexible film web having a longitudinal axis, wherein the flexible web has been folded to define a front package panel 214 and a rear package panel 216 of the package body 212. The front and rear package panels 214 and 216 are joined to each other at respective lateral side margins of the package body 212. In the illustrated embodiment, the front and rear package panels are joined to each other where the flexible film web from which the body is formed has been folded generally at its longitudinal axis, at one side edge of the package. The flexible film web from which the package body 212 is formed is joined to itself along a longitudinal seam 18 which extends parallel to the longitudinal axis of the flexible web. While seam 218 has been illustrated generally at the lateral, side edge of the package, opposite the fold formed along the longitudinal axis, the flexible web can otherwise be joined to itself, such as along a longitudinal seam 218' positioned in the rear package panel 216, as shown in phantom line in FIG. 13.

In accordance with the present invention, package 210 includes a bottom gusset 220 which is positioned between the front and rear package panels 214 and 216, and which extends upwardly and inwardly from lower edges of the front and rear package panels. As will be further described, the pleat-like bottom gusset 220 is formed from a sleeve of material which is positioned within the flexible web from which the package body is formed.

The bottom gusset 220 is joined to and integrated with the package body by a pair of side seals 222 at opposite lateral margins of the package body. In the illustrated embodiment, one of the side seals 222 coincides with, and can be provided by, the longitudinal seam 218 of the package 210. For some applications, it may be desirable to form side seals 222, adjacent bottom gusset 220, which do not extend the full length of the package. A pair of bottom end seals 223 respectively join the edges of the bottom gusset 220 to the front and rear package panels 214 and 216, to provide a bottom seal for the package, with the upper edge portions of the front and rear package panels joined at a heat-sealed top end seal 230. By virtue of the formation technique, the bottom gusset 220, including those portions of the gusset sealed at the side seals 222, extends less than the width of the front and rear package panels 214, 216.

As will be appreciated, access to the contents of the package 210 can be provided configuring the package to include a suitable preferentially weakened region, such as a score line or the like. For some applications, it can be desirable to provide the front panel of the package with a recloseable fastener assembly, such as disclosed in the afore-mentioned patents. Other suitable opening arrangements can be provided as may be desired.

With reference now to FIGS. 14 and 15, formation of the bottom-gusseted package 210 will be described. For package formation, a flexible web 240 preferably comprising heat-sealable polymeric material is provided, with a flexible web typically advanced in a direction along its longitudinal axis. Formation of the present bottom-gusseted package is further effected by providing a flexible, sleeve-forming web 242, also preferably comprising suitable polymeric, heat-sealable material. The composition of the sleeve-forming web can differ from the flexible web 240 for forming the package of the body, as may be desired. It is presently contemplated that only one side of the sleeve-forming web be heat-sealable, so that the inside surface of the folded, sleeve-forming web does not heat seal to itself. This permits the eventual opening and spreading of the legs of the bottom gusset 220 so that the package 210 can assume a generally self-standing orientation.

As shown on FIG. 14, the sleeve-forming web 242 may be provided with a tubular configuration. Individual sleeves 244 are cut from the sleeve-forming web 242, and are positioned transversely of the longitudinal axis of the flexible web 240 from which the package body is formed. For some applications, it can be desirable to close or seal each individual sleeve 244, such as with suitable adhesive. This can be desirable to maintain the sleeves in a generally closed, flattened configuration, as packages are being formed, including during advancement through the associated form, fill and seal apparatus.

Figure 16:
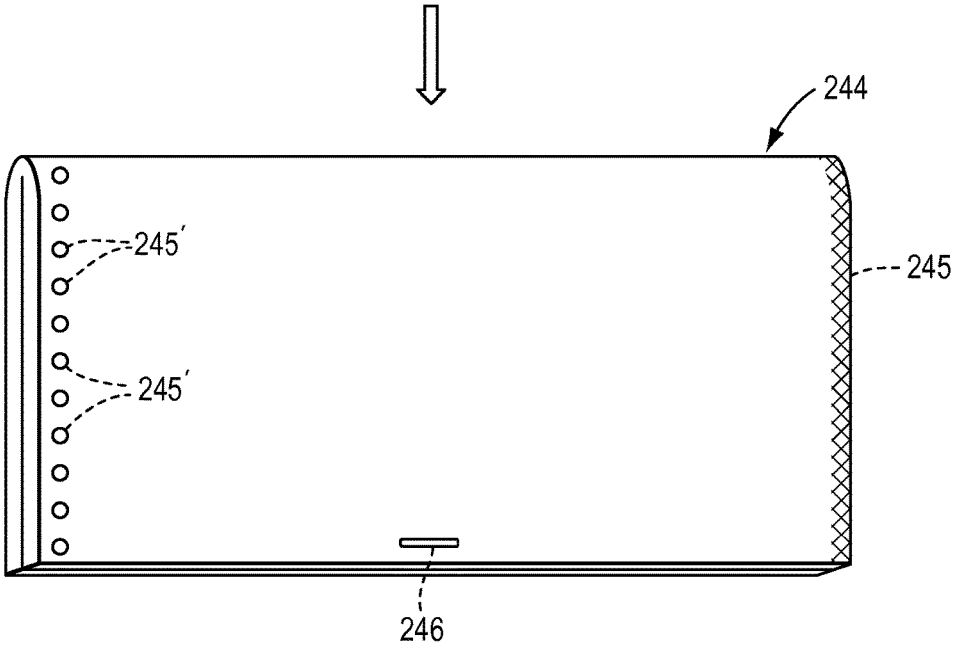
FIG. 16 is a view illustrating features for facilitating formation and filling of packages made in accordance with the present invention.

FIG. 16 diagrammatically illustrates various contemplated arrangements for closing each of the sleeves 244. For example, at least one of the ends each sleeve 244 can be closed by suitable adhesive at the inside surface thereof, such as by a bead of adhesive 245, and a plurality of adhesive dots 245'. Alternatively, a central portion of each of the sleeve can be provided with a temporary seal or adhesive 246. Instead of adhesive, pin-holes seals can be provided to provide the desired closing of each sleeve, with any closing or seal provided at the central portion of each sleeve being temporary in nature so that the resultant gusset can open and splay at intended subsequent to product filling. Other suitable arrangements for closing the sleeves 244 can be employed.

The individual sleeves 244 are joined to the flexible web 240 in spaced apart relationship longitudinally of the web 240. The spacing between the individual sleeves 244 corresponds to the length of each of the bottom-gusseted packages 210 being formed. Each of the sleeves 244 is joined, such as by heat-sealing, to the web 240, such as by seals provided at the ends of each sleeve. The sleeves 244 can otherwise be joined to the web 240, with the understanding that the sleeves are to be joined in a manner which does not inhibit the eventual opening and splaying of each sleeve as it becomes the bottom gusset of a resultant package.

After each of the individual sleeves 244 is joined to the flexible web 240, the flexible web is folded and the lateral margins thereof joined together to form a folded flexible web. In this way, a package body is formed for each of the bottom-gusseted packages. By folding of the flexible web 240, the front and rear package panels 214 and 216 of each package are formed. The folded flexible web 240 can be joined to itself so as to form longitudinal seam 218, with the front and rear package panels joined to each other at the lateral margins of the folded web. As illustrated, the individual sleeves 244 are positioned within the folded flexible web 240.

It is presently contemplated that formation in this manner can be effected, if desired, during packaging on a form, fill, and seal machine, or that individual packages can be formed for subsequent filling. Depending upon the specific formation technique, side seals 222 are typically formed prior to filling, with each of the side seals overlapping the respective end of the bottom gusset 220, with one of end seals 223 formed after the contents of each package have been positioned therein.

In connection with formation of the bottom end seals 223, an important aspect of the preferred practice of the invention promotes efficient, high-speed formation. Specifically, the present method includes intermittently advancing the flexible web of material 240 after the individual sleeves 244 have been joined thereto, such as during advancement through the associated form, fill and seal machine. During this process, the flexible web of material is advanced with a longitudinal tolerance range of dimension $T_{LD}$, that is, is advanced with a precision that varies, plus or minus, by a generally known amount. This specific tolerance range is typically dependent upon the specific operational parameters of the forming apparatus, such as the associated form, fill, and seal machine, with the tolerance range typically increasing at increasing operating speeds. Additionally, it will appreciated that there can be some inaccuracy in the longitudinal positioning of the individual sleeves 244 on the flexible web of material 240, with this range of longitudinal variation, which may be zero, designated $C_{LD}$.

Notably, the present method includes forming top and bottom seals end 230, 223 in adjacent ones of the packages being formed by operation of a pair of heat sealing jaws 250, wherein the spacing between the top and bottom end seals of adjacent ones of the packages is equal to or greater than the sum of: (1) two times the tolerance range with which the flexible 240 is advanced (e.g., $2\times T_{LD}$), and (2) the range of variation of the longitudinal placement of each sleeve 244 (e.g., $C_{LD}$.) This is diagrammatically illustrated in FIG. 15, which shows the two pairs of heat sealing jaws 250, 250 are positioned to provide a dimension D between the end seals 223, 230 of adjacent packages, which is equal to or greater this sum. This ensures proper sealing of the ends of each package, with each bottom gusset properly sealed and configured to open or splay for providing the desired interior volume to the package, and desired self-standing characteristics. Thus, the spacing between the top and bottom end seals of adjacent ones of the packages is equal to or greater than two rimes $T_{LD}$ plus $C_{LD}$.

As will be recognized by those familiar with the art, this type of machine intermittently advances packaging material through the machine, with typical variation with respect to the web-cutting apparatus being plus/minus 0.25 inches. Thus, a typical sleeve portion 244 can be provided with a folded width of approximately 3 inches, with seals formed joining each sleeve portion 244 to the web 240 being of sufficient length and width to accommodate this variation, while still ensuring that a sufficiently large portion of each seal remains, after cutting of the web, to form the bottom end seals 223 and the top seals 230 of the necessary size to ensure package integrity. As will be appreciated, this dimensioning is meant to be illustrative, but it will be recognized that the present invention can readily be practiced to accommodate this typical cutting position variation of a typical forming apparatus.

Efficient package formation is promoted by configuring each of said individual sleeves to have a length which is less than the width of the folded web of flexible material. This provides formation of the bottom gusset with a width less than the width of the package, to permit formation of side seals 222 between the front and rear package panels 214, 216 of each said package at opposite side edges of the bottom gusset 220 of the package. As noted each of these sides seals 222 overlaps a respective end of the bottom gusset 220 of the package 210.

The preferred dimensioning of the individual sleeves 244 for formation of respective bottom gussets 220, and the preferred dimensioning of the side seals 223 joining the front and rear package panels 214, 216 is illustrated in FIG. 14. As discussed above in connection with end seals of the packages, this preferred dimensioning accommodates manufacturing variations and tolerances.

As will be appreciated, the flexible web of material 240 can exhibit some transverse variation in its positioning as it is intermittently advanced, with this transverse tolerance range being designated $T_{TD}$. Additionally, each of the individual sleeves 244 being positioned transversely of said flexible web of material may exhibit some variation in the positioning transversely of the web of material 240, with this transverse tolerance range being designated $C_{TD}$.

Given these inevitable minor variations in the manufacturing process, it is contemplated that the width of the package gusset, designated $G_W$, which corresponds to the length of each individual sleeve 244, be selected to correspond to the width of the front and rear package panels, designated $BP_W$. As shown, this relationship can be stated as the gusset width $G_W$ is less than or equal to: (1) the package panel width $BP_W$, (2) less two times the tolerance range $T_{TD}$, and (3) less the tolerance range $C_{TD}$.

In turn, the side seals 222 which are formed in each package joining the front and rear package panels 214, 216 at opposite side edges of the bottom gusset of the package are dimensioned to ensure the preferred overlapping of the side seals with the opposite ends of the respective bottom gusset. As shown, the width dimension of each side seal, designated $G_{SS}$, is equal to or greater than: two times the transverse tolerance range $T_{TD}$, plus the transverse tolerance range $C_{TD}$. Again, this ensures the preferred overlapping of the side seals with the associated gussets, notwithstanding the normal manufacturing tolerances exhibited by the equipment employed for practicing the present invention.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A method of making bottom-gusseted packages, comprising the steps of:

providing a flexible web of material having a longitudinal axis, providing a flexible, sleeve-forming web;

cutting said flexible, sleeve-forming web into a plurality of individual sleeves;

joining said individual sleeves to said flexible web in spaced apart relationship longitudinally of said flexible web, with the spacing between said individual sleeves corresponding to the length of each of said bottom-gusseted packages being formed;

folding said flexible web of material and joining lateral margins thereof to form a folded flexible web, and to thereby form a package body on each of said bottom-gusseted packages, each package body including a front package panel and a rear package panel joined at opposite side margins thereof, said individual sleeves being positioned within said folded flexible web; and cutting said folded flexible web at intervals each corresponding in length to said length of each of said bottom-gusseted packages, whereby each individual sleeve provides a bottom gusset for one of the packages being formed, said cutting step includes cutting through each of said individual sleeves, wherein a portion of each individual sleeve provides: (1) said bottom gusset on one of the packages being formed, and (2) a top sleeve portion comprising a pair of flanges on an adjacent one of said packages being formed, including forming an end seal between said front and rear package panels below said pair of flanges of said top sleeve portion, and forming side seals at opposite ends of said pair of flanges of said top sleeve portion.

2. A method of making bottom-gusseted packages in accordance with claim 1, wherein each of said individual sleeves has a length which is less than the width of the folded web of flexible material to facilitate formation of said bottom gusset with a width less than the width of the package, said method including formation of side seals between the front and read package panels of each said package at opposite side edges of the bottom gusset of the package, each of said side seals overlapping a respective end of said bottom gusset.

3. A method of making bottom-gusseted packages in accordance with claim wherein:

said sleeve-forming web comprises a folded web of sleeve-forming material, wherein an inside surface of said folded sleeve-forming web does not heat-seal to itself.

4. A method of making bottom-gusseted packages in accordance with claim 1, wherein:

each said package being formed has a package panel width of BPW, and wherein said flexible web of material is advanced with a transverse tolerance range of TTD, each of said individual sleeves being positioned transversely of said flexible web of material with a transverse tolerance range of CTD, each of said individual sleeves having a length corresponding to a width GW of the gusset of each package, wherein GW is less than or equal to: the package panel width BPW, less two times the tolerance range TTD, and less the tolerance range CTD.

5. A method of making bottom-gusseted packages in accordance with claim 4, wherein:

each said package is formed with side seals joining said front and rear package panels of each package at opposite side edges of the bottom gusset of the package, each of said side seals having a width GSS which is equal to or greater than: two times the transverse tolerance range TTD, plus the transverse tolerance range CTD.

6. A method of making bottom-gusseted packages in accordance with claim 1, wherein:

said sleeve-forming web comprises a folded web of sleeve-forming material, wherein an inside surface of said folded sleeve-forming web does not heat-seal to itself.

7. A method of making bottom-gusseted packages in accordance with claim 1, including:

closing each of said individual sleeves prior to joining said individual sleeves to said flexible web of material.

8. A method of making bottom-gusseted packages in accordance with claim 1, including forming said side seals at opposite ends of said top sleeve portion to extend below said top sleeve portion.

* * * * *